United States Patent [19]

Feltz et al.

[11] Patent Number: 4,812,822

[45] Date of Patent: Mar. 14, 1989

[54] ELECTRONIC ARTICLE SURVEILLANCE SYSTEM UTILIZING SYNCHRONOUS INTEGRATION

[75] Inventors: John F. Feltz, Fairborn; John W. Taylor, Springboro; Richard S. Vuketich, Dayton, all of Ohio

[73] Assignee: Monarch Marking Systems, Inc., Dayton, Ohio

[21] Appl. No.: 91,423

[22] Filed: Aug. 31, 1987

[51] Int. Cl.[4] ..... G08B 13/24

[52] U.S. Cl. ..... 340/572; 340/551

[58] Field of Search ..... 340/572, 551

[56] References Cited

U.S. PATENT DOCUMENTS

| | | | |
|---|---|---|---|
| 3,863,244 | 1/1975 | Lichtblau | 340/572 |
| 3,868,669 | 2/1975 | Minasy | 340/572 |
| 4,531,117 | 7/1985 | Nourse et al. | 340/572 |

*Primary Examiner*—Glen R. Swann III

*Attorney, Agent, or Firm*—Mason, Kolehmainen, Rathburn & Wyss

[57] ABSTRACT

An electronic article surveillance system employs a resonant tag attached to an article being protected. An interrogation transmitter whose transmission frequency is periodically swept through the resonant frequency of the tag is positioned near an exit of the protected area. The resonant tag is periodically energized by the transmitter as the transmitter frequency passes through the resonant frequency of the tag to cause the tag to emit a periodic tag signal at the sweep rate of the transmitter. The tag signal is received by a receiver that generates an alarm upon the detection of a tag signal. The receiver employs synchronous integration in the form of a dual channel synchronous video integrator to independently process positive and negative pulses of the tag signal in order to differentiate the tag signal from extraneous signals and noise.

20 Claims, 5 Drawing Sheets

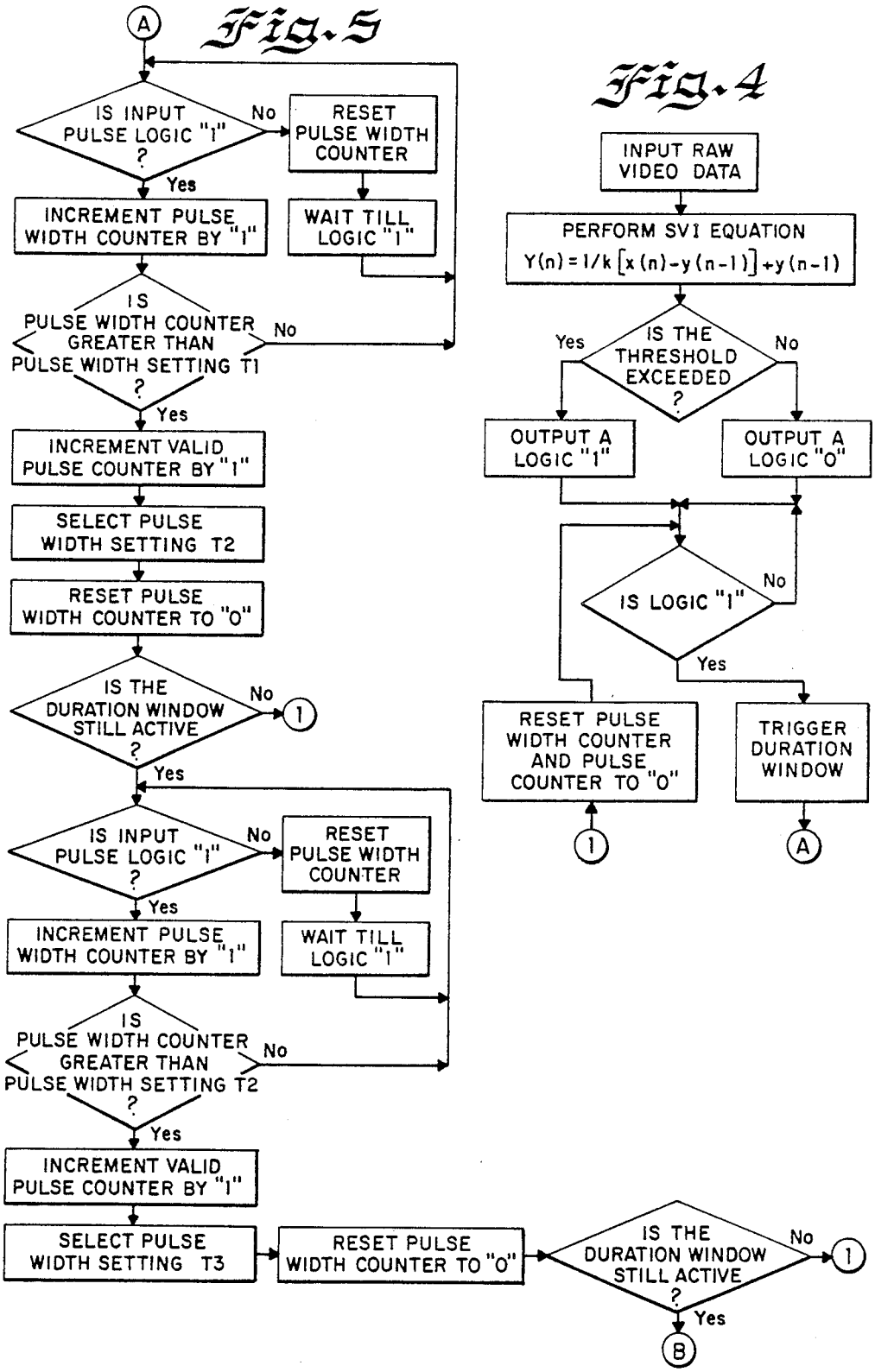
Fig. 5
A
IS INPUT PULSE LOGIC "1" ?
No
RESET PULSE WIDTH COUNTER
Yes
INCREMENT PULSE WIDTH COUNTER BY "1"
WAIT TILL LOGIC "1"
IS PULSE WIDTH COUNTER GREATER THAN PULSE WIDTH SETTING T1 ?
No
Yes
INCREMENT VALID PULSE COUNTER BY "1"
SELECT PULSE WIDTH SETTING T2
RESET PULSE WIDTH COUNTER TO "0"
IS THE DURATION WINDOW STILL ACTIVE ?
No
1
Yes
IS INPUT PULSE LOGIC "1" ?
No
RESET PULSE WIDTH COUNTER
Yes
INCREMENT PULSE WIDTH COUNTER BY "1"
WAIT TILL LOGIC "1"
IS PULSE WIDTH COUNTER GREATER THAN PULSE WIDTH SETTING T2 ?
No
Yes
INCREMENT VALID PULSE COUNTER BY "1"
SELECT PULSE WIDTH SETTING T3
RESET PULSE WIDTH COUNTER TO "0"
IS THE DURATION WINDOW STILL ACTIVE ?
No
1
Yes
B
Fig. 4
INPUT RAW VIDEO DATA
PERFORM SVI EQUATION
Y(n) = 1/k [x(n) - y(n-1)] + y(n-1)
IS THE THRESHOLD EXCEEDED ?
Yes
No
OUTPUT A LOGIC "1"
OUTPUT A LOGIC "0"
IS LOGIC "1"
No
Yes
RESET PULSE WIDTH COUNTER AND PULSE COUNTER TO "0"
TRIGGER DURATION WINDOW
1
A

ELECTRONIC ARTICLE SURVEILLANCE SYSTEM UTILIZING SYNCHRONOUS INTEGRATION

BACKGROUND OF THE INVENTION

1. Field of the Invention

This invention relates generally to electronic article surveillance systems, and more particularly to electronic article surveillance systems that utilize a resonant tag that is affixed to an article being protected. In particular, the present invention relates to a system that utilizes a transmitter and an associated receiver at a gate or exit from an area being protected. The carrier frequency of the oscillator is swept through a range of frequencies including the resonant frequency of the tag, thereby causing the big to resonate periodically as the carrier frequency passes through the resonant frequency of the tag. The receiver picks up perturbations in the transmitted signals, also known as tag signals, caused by the presence of a tag in the transmitted field. The detected signals are processed to reduce noise and determine whether a valid tag signal is present. If a valid tag signal is received, an alarm is sounded.

2. Prior Art

Article surveillance systems are known, a typical swept frequency oscillator being shown in U.S. Pat. No. 3,868,669 to Minasy. Unfortunately, such systems have a tendency to respond to spurious signals that are present in the environment, particularly in an urban environment, and thus generate false alarms. Various attempts have been made to reduce such nuisance alarms. For example, Minasy periodically deactivates the system to discriminate against off-frequency signals, but this technique does not eliminate interfering signals at the tag frequency. Because of the small amplitude of a tag signal relative to the noise and other interfering signals generally present, it is difficult to make the system sensitive to tag signals without making it susceptible to interference from other signals. Various types of discrimination, such as frequency, amplitude, width, polarity, etc., have been used to discriminate the tag signal from noise and other signals, but these attempts have not been entirely successful.

SUMMARY OF THE INVENTION

Accordingly, it is an object of the present invention to provide an electronic article surveillance system that overcomes many of the disadvantages of the prior art systems.

It is another object of the present invention to provide an electronic article surveillance system that is better adapted to distinguish valid tag signals from noise.

It is yet another object of the present invention to provide an electronic article surveillance system that minimizes the number of false or nuisance alarms caused by extraneous signals.

It is yet another object of the present invention to provide an electronic article surveillance system that utilizes digital processing circuitry to distinguish valid tag signals from extraneous noise.

It is another object of the invention to provide an electronic article surveillance system that utilizes synchronous integration to discriminate valid tag signals from other signals.

In accordance with a preferred embodiment of the invention, a transmitter is provided at an exit from an area being protected. The output of the transmitter is supplied to a transmitting antenna, preferably a magnetic or Faraday antenna. The carrier frequency of the transmitted signal is approximately equal to the resonant frequency of a resonant circuit contained in a tag attached to a protected article. The carrier frequency is swept over a range of frequencies by a sweep oscillator so that the carrier frequency periodically passes through the resonant frequency of the tag, thereby causing a tag signal to be produced at periodic intervals that are related to the frequency of the sweep oscillator. In most instances, two tag signals will be produced during each cycle of the sweep oscillator.

The swept transmitted signal and any tag signals are received by a receiving antenna positioned in proximity to the transmitting antenna. The receiving antenna is generally a magnetic antenna which may be similar or identical to the transmitting antenna, and its outputs are applied to a receiver. The signals from the receiving antenna are amplified, filtered and detected in a conventional manner. However, in accordance with an important aspect of the invention, the detected signals are applied to positive and negative threshold detectors to separate the positive polarity components of the detected signal from the negative polarity components for independent signal processing. The signals that exceed the threshold of the positive threshold detector are applied to a positive pulse synchronous video integrator, and the signals that exceed the threshold of the negative threshold detector are applied to a negative pulse synchronous video integrator. The positive pulse and negative pulse synchronous video integrators are synchronized with the sweep oscillator that sweeps the carrier frequency of the transmitted signal, and serve to take a plurality of samples of the signals from the positive and negative threshold detectors during each sweep of the sweep oscillator. The samples are then integrated over a plurality of sweeps of the sweep oscillator. This causes signals, such as tag signals, whose period and phase is synchronized with that of the sweep oscillator to be reinforced. Signals that are not period synchronized to the sweep oscillator and not phase synchronized to the transmitter frequency are not reinforced, but rather, tend to cancel. Thus, over a period of several sweeps, the positive and negative components of a signal produced by a tag are reinforced and appear at the output of the respective positive pulse and negative pulse synchronous video integrators. These output signals are then combined in a combiner to provide a single polarity signal that is a composite of the outputs of the positive pulse and negative pulse synchronous video integration. The signal from the combiner is applied to a second detector for further processing including pulse width and other discrimination. If the signal applied to the second detector meets the discrimination criteria of the second detector, the second detector will cause a theft alarm to be sounded.

DESCRIPTION OF THE DRAWING

These and other objects and advantages of the present invention will become readily apparent upon consideration of the following detailed description and attached drawing, wherein:

FIGS. 4–6 are logical flow charts illustrating the operation of the system of the present invention; and FIGS. 7 and 8 are block diagrams of alternative embodiments of synchronous video integration systems usable as the synchronous video integrator illustrated in FIG. 1.

DETAILED DESCRIPTION

Figure 1:
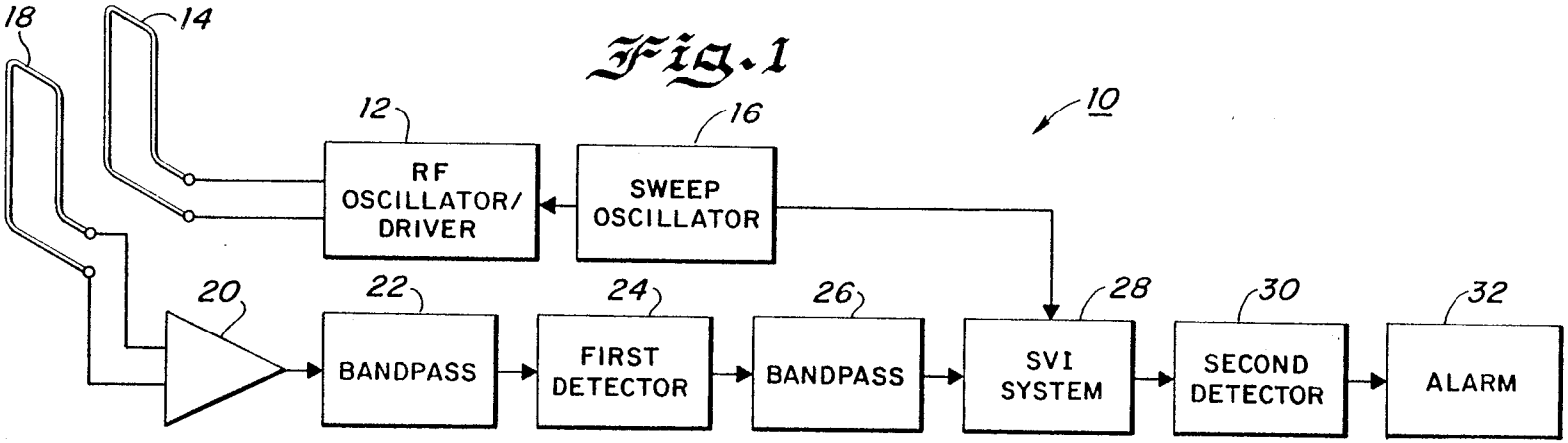
FIG. 1 is a block diagram of the electronic article surveillance system according to the present invention.

Referring now to the drawing, with particular attention to FIG. 1, there is shown a block diagram of the system according to the invention generally designated by the reference numeral 10. The system 10 comprises a transmitting section having a radio frequency oscillator/driver 12 that drives an antenna 14 and is swept by a sweep oscillator 16. The center frequency of the signal provided to the antenna 14 is on the order of the resonant frequency of the tag to be detected. In the illustrated system, the resonant frequency of the tag is on the order of 8.2 mHz, and the RF carrier frequency applied to the antenna 14 is centered at approximately 8.2 mHz. The carrier frequency is swept plus or minus 10% or plus or minus 820 kHz by the sweep oscillator 16. Thus, the frequency of the signal applied to the antenna 14 is swept over a range of 7.38 mHz to 9.02 mHz. Thus, a tag having a resonant frequency anywhere in that range would be detected. The carrier frequency is swept over its frequency range at a sweep rate determined by the frequency of the sweep oscillator 16. Generally, it is desirable to operate the sweep oscillator 16 in the audio range of frequencies, and in the illustrated embodiment, the frequency of the sweep oscillator 16 is on the order of 82 Hz, although other frequencies may be used.

The system 10 also includes a receiving system having an antenna 18, an RF amplifier 20, a bandpass filter 22, a first detector 24 and a second bandpass filter 26. The antenna 18 is preferably a magnetic field or Faraday antenna similar to the antenna 14. One example of such an antenna is disclosed in U.S. patent application Ser. No. 07/092,052, filed concurrently herewith by John F. Feltz, Michael F. Hartings and Richard D. Heaton and entitled "MULTIPLE LOOP ANTENNA" and incorporated herein by reference. The antenna 18 is coupled to an amplifier 20, which may be a conventional RF amplifier. The output of the RF amplifier 20 is coupled to a bandpass filter 22. The bandpass filter 22 is designed to pass signals in the range of frequencies of the swept frequency signal transmitted by the antenna 14 and to reject signals outside of that range. Typically, the bandpass filter 22 may pass signals in the 6.5 mHz to 9.5 mHz range. The signals from the bandpass filter 22 are applied to a first detector 24 which is an amplitude modulation detector and may include a synchronous detector such as an MC1330A1 synchronous detector manufactured by Motorola, Inc.; however, other detectors may be used. The output of the first detector 24 is applied to a second bandpass filter 26 which is intended to filter out signals whose frequency is outside the range of frequencies of a tag signal. Typically, the bandpass filter 26 may have a pass band of on the order of 1 to 4 kHz.

The system 10 according to the invention also includes noise reduction circuitry in the form of a synchronous video integrator system 28 (SVI system) and a second detector 30 which includes pulse width and other discrimination criteria. Only signals that can be integrated to a sufficient amplitude by the SVI system 28 and meet the discrimination characteristics of the second detector 30 can cause the second detector 30 to provide a signal to an alarm 32 to indicate that a tag is present.

Figure 2:
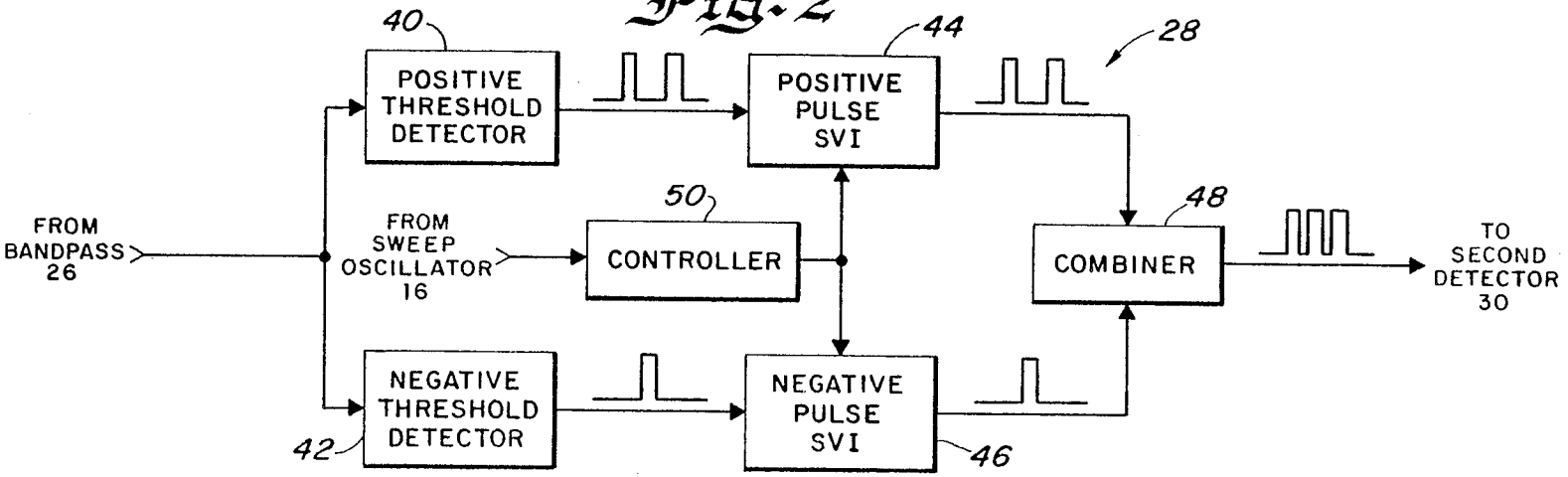
FIG. 2 is a block diagram of a dual channel synchronous video integrator (SVI) usable as the SVI system illustrates in FIG. 1.

A dual channel SVI system usable as the SVI system 28 is illustrated in FIG. 2. Although it is possible to utilize a single channel SVI system to process both positive and negative pulses, it has been found that a dual channel SVI system that processes positive and negative pulses independently is more effective in discriminating against signals that are not time synchronous with the sweep oscillator and not phase synchronous with the transmitter frequency than is a simple single channel SVI system. The dual channel SVI system includes a positive threshold detector 40 and a negative threshold detector 42 whose outputs are applied to a positive pulse SVI 44 and a negative pulse SVI 46, respectively. The outputs of the positive and negative pulse SVIs are combined in a combiner 48. A controller 50 controls the operation of the positive pulse and negative pulse SVIs 44 and 46, respectively, and maintains the SVIs in synchronism with the sweep oscillator 16.

Figure 3:
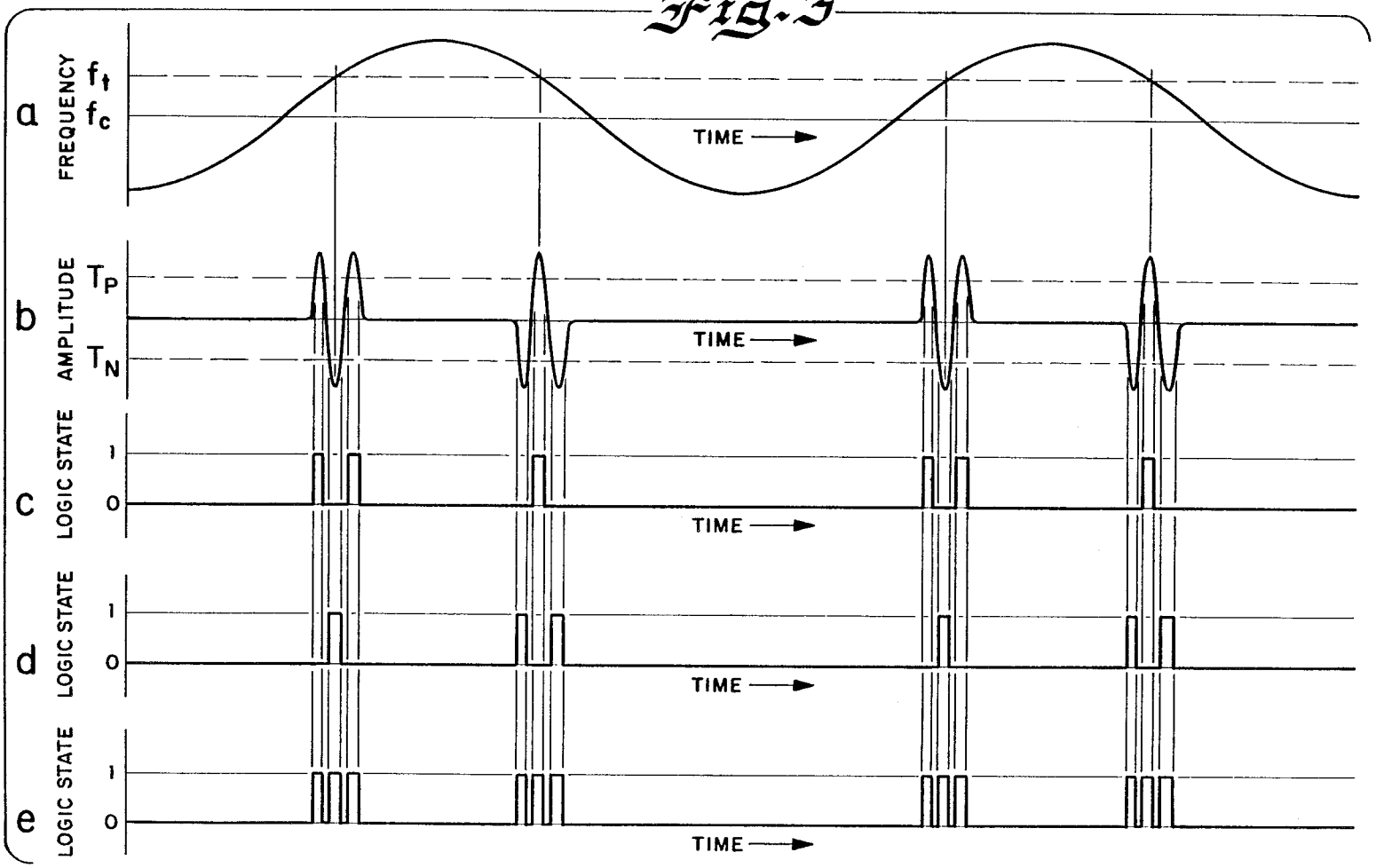
FIG. 3 illustrates various waveforms generated by the system according to the present invention.

The operation of the SVI system 28 of FIG. 2 is best understood if FIG. 2 is considered in conjunction with the waveforms of FIG. 3 which contains five waveforms, FIGS. 3*a* through 3*e*. FIG. 3*a* illustrates the frequency of the interrogation signal provided by the transmitting section of the present invention. As is apparent from FIG. 3*a*, the frequency of the interrogation signal varies sinusoidally about a carrier frequency $f_c$ which is nominally 8.2 mHz in the illustrated embodiment. As previously discussed, the resonant frequency of a tag utilized in conjunction with the present invention is in the range of the interrogating frequency, i.e., 8.2 mHz plus or minus 10%. In FIG. 3*a*, the resonant frequency of a particular tag is indicated by a dashed line captioned $f_t$. It should be noted that although the frequency $f_t$ in FIG. 3*a* is indicated as being slightly higher than the center frequency $f_c$, it should be noted that the resonant frequencies of the individual tags will vary, and that the resonant frequency $f_t$ illustrated in FIG. 3*a* could be anywhere within the range of frequency excursions of the interrogation signal.

As is apparent from FIG. 3*a*, the frequency of the interrogation signal passes through the resonant frequency, $f_t$ of the tag twice during each sweep. Each time the frequency of the interrogation signal passes through the resonant frequency of the tag, a tag signal is generated. Typical tag signals are illustrated in FIG. 3*b* which represent the output of the bandpass filter 26 when a tag is present in the interrogation zone. As is apparent from FIG. 3*b*, as the resonant frequency of the tag is approached from below, the amplitude of the detected signal increases until a positive pulse is generated. As the sweep continues, the amplitude of the signal decreases until a negative pulse is generated. As the sweep further continues, another positive pulse is generated. As the interrogation frequency goes beyond the resonant frequency of the tag, the detected voltage goes back to zero until the tag frequency is again approached in the second portion of the sweep when another tag signal is generated. However, the polarity of the second tag signal is reversed and has two negative polarity pulses with a positive polarity pulse interposed therebetween. On subsequent sweeps, the pattern is again repeated with mirror image pulses being alternately generated.

Two threshold levels are illustrated in FIG. 3*b*, namely a positive threshold $T_P$ and a negative threshold $T_N$ that correspond to the threshold set by the positive and negative threshold detectors 40 and 42, respectively. The threshold detectors 40 and 42 may utilize any suitable comparators such as, for example, an LM393 dual comparator manufactured by Motorola, Inc., which can combine the functions of both of the threshold comparators 40 and 42.

The comparators 40 and 42 provide an output when their respective thresholds are exceeded. The output of the positive threshold comparator 40 is illustrated in FIG. 3*c* and the output of the negative threshold comparator 42 is illustrated in FIG. 3*d*. As is apparent from FIGS. 3*c* and 3*d*, the comparators 40 and 42 each provide a constant amplitude output pulse for as long as one of their respective thresholds is exceeded.

Although not shown in FIG. 3*b*, signals other than those generated by the tag may be present in the output of the bandpass filter 26, and these signals may have an amplitude that can exceed either threshold $T_P$ or $T_N$. However, in accordance with an important aspect of the present invention, it has been recognized that while valid tag signals are both time and phase synchronous with the sweep of the interrogation frequency, interfering signals generally are not. Thus, by passing the outputs from the positive threshold detector 40 and the negative threshold detector 42 to their respective positive and negative pulse synchronous video detectors 44 and 46 the phase synchronous signals produced by a tag will be reinforced while non-synchronous spurious signals will not.

In the SVIs 44 and 46 utilized in the present invention, the signals from the respective threshold detectors 40 and 42 are sampled every 1 microsecond. In the illustrated embodiment, an 82 Hz sweep frequency is utilized. This corresponds to a 12.19 millisecond sweep time which corresponds to 12190 samples of 1 microsecond duration for each sweep. The sampling of the two SVIs 44 and 46 is synchronized to the sweep rate of the interrogation frequency signal so that 12190 samples are taken during each sweep, and each sample is taken at the same point on each sweep interval. For example, sample 1 will always be taken at a point very near the beginning of the sweep and sample 12190 will always be taken near the end of the cycle with all intervening samples being taken at the same point between samples 1 and 12190 during each sweep.

The SVIs may be analogized to a plurality of synchronous switches, each coupled to a memory element comprising a resistance-capacitance (R-C) integrator. Each R-C network is momentarily connected to the output of one of the threshold detectors during its respective sampling period. If the threshold is exceeded, a fixed amount of charge is applied to the capacitor. If not, no charge is added. The capacitor of R-C network slowly discharges during the time interval between sampling periods at a rate determined by the R-C time constant of the network.

The time constant is chosen so that the amount of charge lost between sampling periods is less than the amount of fixed charge applied during the sampling period. Consequently, if the threshold is exceeded for several sampling periods, the charge on the capacitor builds up. If not, the capacitor discharges. By monitoring the accumulated charge (or voltage) on the capacitor, it is possible to determine the number of times the threshold was exceeded within a predetermined time interval determined by the time constant. When the charge builds up to a predetermined level, an output signal is provided indicating that the signal exceeded the threshold for a predetermined number of samples.

The same function may be achieved digitally, for example, by replacing each R-C memory element with a digital memory element such as a shift register. For example, the SVIs 40 and 44 may each contain 12190 8-bit storage elements each corresponding to one of the 12190 samples taken. During the sampling time, if the output of the threshold detector is low during a sample, a zero may be entered into the most significant bit location of the storage device corresponding to that particular sample. If the output of the respective threshold detector is high, a 1 may be entered. During the next sweep, the data from the previous sweep is shifted to the next lower significant bit location. This shift is analogous to the discharge of the capacitor between sampled in the analog system. Current data is inputted into the most significant bit location of each storage device. This corresponds to the addition of a fixed charge or no charge to the capacitor during the sampling period. The process is repeated until all 8-bit locations of each storage device have been loaded with data. The data is then read out of the storage elements and the 8-bit binary number contained therein is analyzed. If it exceeds a predetermined value, an output signal will be generated. This process corresponds to monitoring the charge on the capacitor of R-C integration. In this system, if a signal is synchronous with the SVIs, a 1 will be loaded into the memory element during each sweep, and most locations of the storage device will contain 1's. If the signal is not phase synchronous, as in the case of spurious signals, the signal will shift and jitter relative to sampling point, and zeros will be introduced into the memory device during the times that the signal has shifted. Consequently, the required count will not be reached, and most spurious signals are eliminated.

Assuming interference-free conditions, or assuming that the SVIs have eliminated all non-synchronous signals, the outputs of the SVIs will be similar to the graphs of FIGS. 3*c* and 3*d* and correspond to an integrated version of the outputs of the threshold detectors 40 and 42. These signals are then combined in a combiner such as the combiner 48 to provide a combined signal to the second detector 30 for further analysis. A typical combined signal is illustrated in FIG. 3*e*. with an output pulse being generated each time the tag signal (FIG. 3*b*) exceeds either the positive or negative threshold $T_P$ or $T_N$. Pulse polarity information is not retained in the output of the combiner.

Although specific examples of the operation of the SVIs was given above in hardware terms for purposes of illustration, the SVIs may utilize a microprocessor to compute the following equation for each sample at each sample location:

$$y(n)=1/K[x(n)-y(n-1)]-y(n-1)$$

where:

y(n)=current integrated sample
y(n−1)=previous integrated sample at n−1 time
x(n)=current sample
K=integrating constant The previous integrated sample, y(n−1), corresponds to the value of the bits stored in the storage device immediately prior to the inputting of the current sample. Thus, in the example discussed above, if all 1's were present in the 8-bit storage device, the value of the previous integrated circuit would be equal to 11111111 or 255. A zero in any of the bit positions would lower the count. Thus, it is possible to select a predetermined count as the threshold count indicating a valid sample. The count may be anywhere between 1 and 255 (all 1's), preferably on the order of 200, with a higher count being preferable in noisy environments and a lower count being usable in low noise environments to increase acquisition speed.

Each time a new sample, x(n), is taken, the above equation is recalculated using the latest value of x(n). In the previous example, this corresponds to storing the latest value of the sample in the most significant bit position in the storage device and shifting each of the bits currently stored in the storing device by one position to the next less significant bit position. It should be noted that when this is done, the integrating constant, K, is 2 because a shift to the next less significant bit position corresponds to a division by 2. However, it should be noted that other implementations may be used with different values of K. For example, the shift can be done by shifting the bits 0, 1, 2 or 3, etc., places for multiplication of 1, $\frac{1}{2}$, $\frac{1}{4}$ or $\frac{1}{8}$, respectively, and setting different thresholds (e.g., other than 255) to compensate for the change in the number of places the bits are shifted. When the signal-to-noise ratio of the received signal is favorable, a low value of K will enhance acquisition time by effectively reducing the integration time constant. This occurs because the value of K is analogous to the value of the resistor in an analog resistor capacitor integrator. When signal-to-noise ratio is poor, a high integration time is required, and consequently, a high value of K will be required to enhance the sensitivity of the system and the probability of acquisition.

Referring to FIG. 4, the raw video data from one of the positive or negative threshold detectors 40 and 42 is operated upon one of the positive or negative pulse SVIs 44 or 46 (FIG. 2) and the SVI equation previously discussed is performed. The SVI equation is continuously recalculated for each sample of data taken, i.e., at a 1 mHz rate in the illustrated embodiment, and the results of the computation are continuously monitored to determine whether the threshold (e.g., 200) is exceeded or attained. If so, a logic 1 is output, if not, a logic 0 is output. As long as a logic 0 is present, the system simply continues to recalculate the SVI equation. If a logic 1 is present, the duration window which corresponds to the longest expected time interval of the three pulse tag signal is triggered.

Figure 5:
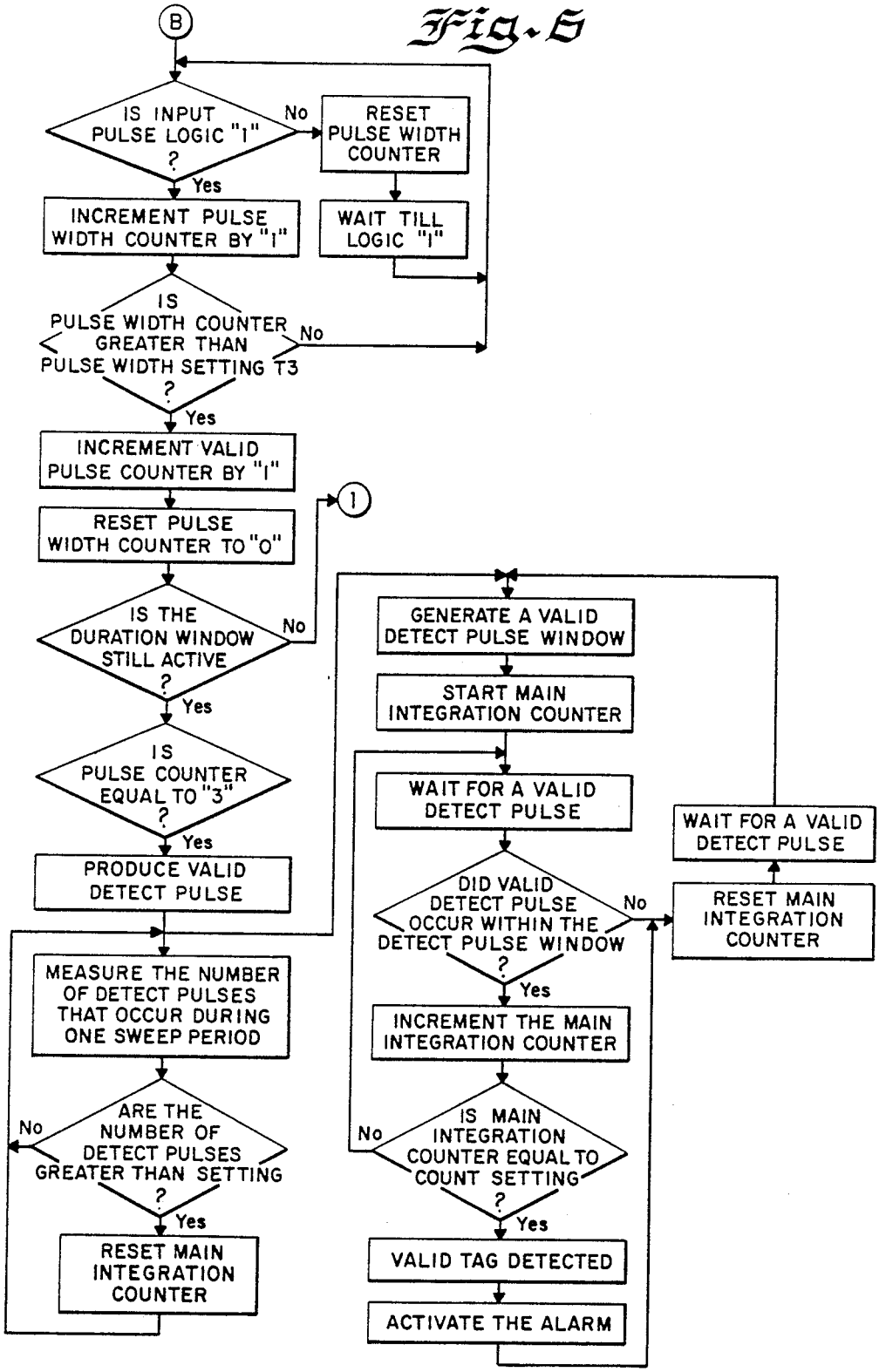

Referring now to FIG. 5, after the time duration window has been triggered, a determination is made as to whether the input pulse is still a logic 1. If not, the pulse width counter, which measures the width of the first pulse, is reset until the next logic 1 is received. If the input pulse is a logic 1, the pulse width counter is incremented by 1 and a determination is made as to whether the pulse width is greater than a predetermined pulse width setting T1 which corresponds to the minimum acceptable width of the first pulse. If not, the state of the input pulse logic is monitored and the pulse width counter is incremented for as long as the pulse logic remains a 1 until the count in the pulse width counter exceeds the setting T1. When this occurs, a valid pulse is indicated and the valid pulse counter is incremented by 1. A new pulse width, T2, which corresponds to the minimum width of the second pulse, is then selected. The pulse width counter is then reset to 0 and a determination is made as to whether the duration window is still active. As previously stated, the duration window represents the maximum expected total time duration of the three pulse tag signal, and consequently, if the duration window is not active after the occurrence of only one pulse, the signal is not a tag signal and the pulse width counter and the pulse counter are reset to 0 (FIG. 4).

If the duration window is still active, the width of the second pulse is determined in the same manner as the width of the first pulse was determined, except that the second pulse must have a width greater than the setting T2. If the pulse width of the second pulse is greater than the time T2, the valid pulse counter is incremented by 1 to indicate that two valid pulses have been received and the value of the minimum pulse width for the third pulse, T3 is selected. The pulse width counter is again reset to 0 and a determination is made as to whether the duration window is still active. If not, the pulse width counter and pulse counters are again reset to 0 and the output of the SVI is again monitored. However, if the duration window is still active, the width of the third pulse is monitored in the same way as the widths of the first two pulses were monitored to determine whether the width of the third pulse exceeds the setting T3. If so, the valid pulse counter is incremented by the 1 and the pulse width counter is again reset to 0. The duration window is checked to determine whether it is still active. If not, the three pulses received are not a valid tag signal, but if so, a determination is made as to whether the count in the pulse counter is equal to 3. If so, a valid detect pulse signal is generated. Thus, the above logic determines whether 3 pulses each having the proper minimum pulse width have been determined within the predetermined pulse window.

In order to further discriminate against noise, more than one group of three valid pulses must be received in order to generate an alarm. In order to generate an alarm, a predetermined number of valid detect pulses must be detected during each sweep period, but no more than a predetermined number can occur. Also, a predetermined number of valid detect pulses must be received before an alarm is activated. For example, the system may require that a predetermined number of consecutive valid detect pulses be received or that a predetermined number be received with a predetermined time. For example, ten consecutive pulses may be required, or eight out of ten. These functions are illustrated in the lower portion of the logic diagram of FIG. 6. The valid detect pulses are monitored and the number of valid detect pulses that occur during one sweep period are counted. A determination is then made as to whether the number of detected pulses during a sweep period are greater than a predetermined setting, which is 1 in the present embodiment, but may be another number, for example 2, if desired. If the number of pulses is greater than the predetermined setting, the main integration counter is reset and the pulses resulting from the next sweep are again measured. If the number of pulses does not exceed the setting, the main integration counter is not reset.

Upon the detection of a valid detect pulse, a valid detect pulse window is generated and the main integration counter is started. The system then waits for the next valid detect pulse, and a determination is made as to whether the next pulse occurred within the detect pulse window. In the illustrated embodiment, the duration of the valid pulse window is made approximately equal to the sweep period of the interrogation signal to require, that in the present embodiment that one valid detect occurred during each sweep period. If the valid detect pulse did not occur within the valid detect pulse window, the main interrogation counter is reset and the system waits for the next valid detect pulse. If the valid detect pulse occurred within the detect pulse window, the main integration counter is incremented and a determination is made as to whether the count in the main integration counter is equal to another setting which corresponds to the number of valid detect pulses (consecutive or otherwise) that must be produced in order to indicate that a valid tag has been detected. If the count of the main integration counter is not equal to the setting, the system waits for the next valid detect pulse until the count in the main integration counter equals the setting. When this occurs, it is indicative that a valid tag has been detected and the alarm is activated. The main integration counter is then reset and the system waits for the next valid detect pulse.

Figure 7:
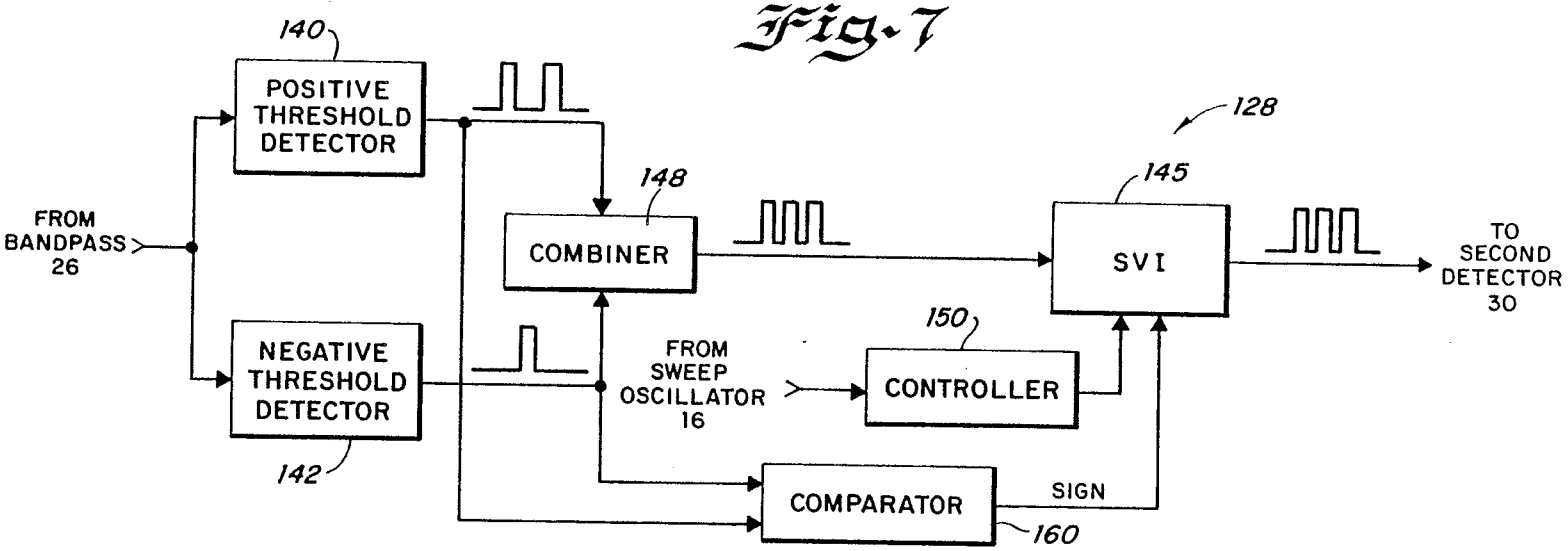
Figure 9:
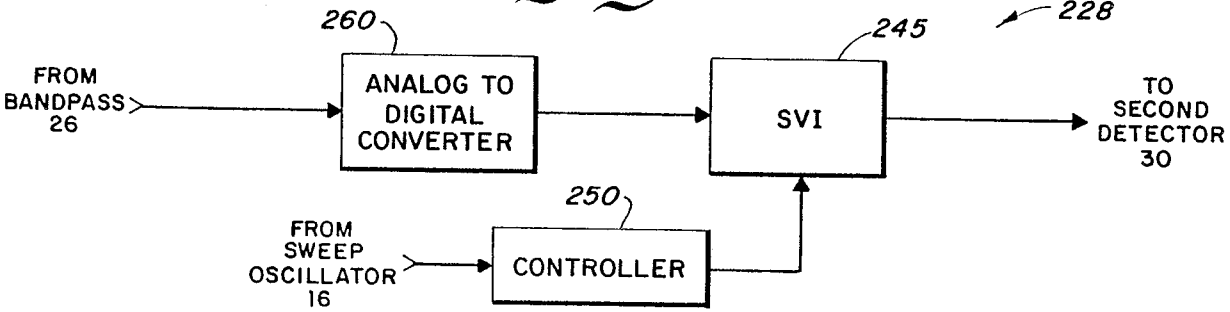

As previously stated, the dual channel SVI described above is useful for discriminating against spurious signals because it requires two criteria to be met before a signal is reinforced because two criteria must be met; namely, the period of the signal must be in synchronism with the period of the sweep rate and the signal must be in phase synchronism with the carrier frequency of the interrogating transmitter. If either of these criteria is not met the signal will be rejected. Also, as previously stated a single channel SVI may be used to discriminate against undesired signals, but a single channel SVI generally required only periodic synchronism and not phase synchronism. However, there are ways to obtain the advantages of a dual channel SVI utilizing a signed single channel SVI that utilizes sign or polarity information in the integration. Such a system is illustrated in FIG. 7. Referring to FIG. 7, there is illustrated an alternative embodiment of an SVI system generally designated by the reference numeral 128. The SVI system 128 provides essentially the same function as the SVI system previously discussed and may be used in place of the SVI system 28 in FIG. 1.

Basically, the signal from the bandpass 26 is applied to a positive threshold detector 140 and a negative threshold detector 142 that function in the same manner as the positive and negative threshold detectors 40 and 42 of FIG. 2. However, rather than applying the outputs of the positive and negative threshold detectors 140 and 142 to separate SVIs, the outputs are provided to a combiner 148 which combines the signals as illustrated by the waveforms of FIG. 7 and applies the combined waveform to a single channel SVI 145 whose output is applied to the second detector 30. A controller 150, similar to the controller 50 synchronizes the SVI 145 with the sweep oscillator 16.

The system as described up to this point will not discriminate against signals that are period synchronized with the sweep oscillator 16, but not phase synchronized with the carrier frequency of the transmitter. In order to provide the phase synchronization criterion, the SVI 145 is provided with another bit of information that defines the sign of each sample. Such sign information is provided by a comparator 160 that compares the outputs of the positive and negative threshold detectors 140 and 142. If the output of the positive threshold detector exceeds the output of the negative threshold detector, a signal, for example, a 1, is provided to indicate to the SVI 145 that the signal being received is a positive polarity signal. Similarly, if the output of the negative threshold detector exceeds the output of the positive threshold detector, a signal, such as a zero, is provided to the SVI indicating that the received signal has a negative polarity. The sign is processed by the SVI 145 in conjunction with the signal from the combiner 145. For any sample, if the sign information indicates a positive polarity sample, the value of that sample is added to the value of the accumulated value of the corresponding sample. If the sign information indicates that the signal is a negative polarity signal, the value of the sample is subtracted from the accumulated value of the corresponding sample. Thus, if the majority of the samples taken along successive sweeps are of the same polarity, either positive or negative, the signal will be reinforced, if they are of alternating or random polarities, they will tend to cancel and not pass by the SVI system.

In yet another alternative embodiment (FIG. 8), another SVI system 228 that utilizes another approach to synchronous video integration is illustrated. The previous SVI systems 28 and 128 did not utilize information defining the amplitude of the pulse received from the bandpass 26 in performing the integration. Rather, the SVI system 28 and 128 discarded amplitude information by utilizing threshold detectors. The only amplitude criterion used was whether or not the amplitude of the pulse exceeded the threshold level. If it did, a fixed quantity was added to (or subtracted from) the accumulated sample value. If it did not nothing was added or subtracted.

The SVI system 228 illustrated in FIG. 8, utilizes amplitude information by applying the signal from the bandpass 26 to an analog-to-digital converter 260 that provides a digital representation of the amplitude of the analog signal received from the bandpass 26 to an SVI 245. The SVI 245 is controlled by the controller 250 whose function is analogous to the controllers 50 and 150. The SVI 245 samples the signal from the analog-to-digital converter at a rate synchronized with the sweep rate of the sweep oscillator 16. However, rather than adding or subtracting a fixed quantity from the accumulated samples, a quantity representative of the amplitude of the sample is added to the accumulated sample. Thus, the output of the SVI 245 is a signal representative of the actual waveform of the signal from the bandpass 26 integrated over several sweeps. In this manner the system operates more like an analog RC integrator in preserving amplitude information. The system 228 of FIG. 8 is more complex than the SVI systems 28 and 128 discussed above, but has the advantage of providing better performance in noisy environments.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A detector for detecting the presence of a resonant tag in a swept frequency field, comprising:

means for detecting the signal produced by a tag present in the swept frequency field, said tag produced signal having positive and negative polarity pulses;

means for separating said positive and negative pulses;

means including a synchronous digital integrator synchronized to the swept frequency field coupled to said separating means for sampling each positive polarity pulse a plurality of times and integrating each sample of the positive polarity pulses over a plurality of sweeps;

means including a synchronous digital integrator synchronized to the swept frequency field coupled to said separating means for sampling each negative polarity pulse a plurality of times and integrating each sample of the negative polarity pulses over a plurality of sweeps; and means coupled to said positive pulse integrating means and to said negative pulse integrating means for providing a detect signal in response thereto upon the detection of a tag produced signal.

2. A detector as recited in claim 1 wherein said detect signal providing means is responsive to pulses received from said integrating means and includes means for determining the widths of the pulses received from said integrating means, said detect signal providing means being responsive to the widths of said received pulses for providing a detect signal only if the widths of said pulses exceed a predetermined width.

3. A detector as recited in claim 1 wherein said detect signal providing means is responsive to pulses received from said positive and negative pulse polarity integrating means, and includes means for counting the pulses received from the integrating means and for providing said detect signal only if a predetermined number of pulses are received within a predetermined time interval.

4. A detector as recited in claim 1 wherein said tag produced signal detecting means includes threshold means for passing signals detected by said tag produced signal detecting means only if the amplitude of the detected signals exceed a predetermined amplitude.

5. A detector as recited in claim 1 further including means interposed between said positive and negative polarity synchronous integrators and said detect signal providing means for combining the signals from said positive and negative synchronous integrators into a combined signal for application to said detect signal providing means.

6. A detector as recited in claim 5 wherein the combined signal provided by said providing means is a unipolarity signal.

7. A detector for detecting the presence of a resonant tag in a swept frequency field, comprising:

means for detecting the signal produced by a tag present in the swept frequency field, said tag produced signal having positive and negative polarity pulses;

means for separating said positive and negative pulses;

means including a synchronous integrator coupled to said separating means for integrating positive polarity pulses;

means including a synchronous integrator coupled to said separating means for integrating negative polarity pulses; and means coupled to said positive pulse integrating means and to said negative pulse integrating means for providing a detect signal in response thereto upon the detection of a tag produced signal, wherein said detect signal providing means is responsive to pulses received from said positive and negative pulse polarity integrating means, and includes means for counting the pulses received from the integrating means and for providing said detect signal only if a predetermined number of pulses are received within a predetermined time interval, and wherein said counting means includes means for providing said detect signal only if at least a first predetermined number of pulses are received within a first predetermined time interval and no more than a second predetermined number of pulses are received in a second predetermined time interval.

8. A detector as recited in claim 7 wherein said counting means further includes means for providing said detect signal only if at least a third predetermined number of pulses are received within a third predetermined time interval, said third predetermined time interval being longer than said first and second predetermined time intervals.

9. A detector as recited in claim 8 wherein the length of said third predetermined time interval is greater than twice the length of said second predetermined time interval.

10. A detector as recited in claim 8 wherein the length of said third predetermined time interval is on the order of approximately twice the length of said second predetermined time interval.

11. A detector for detecting the presence of a resonant tag in a swept frequency field that has a periodic sweep rate, comprising:

means for detecting the signal produced by a tag present in the swept frequency field to provide a detected signal that contains a tag signal when a tag is present;

means including a synchronous digital integrator coupled to said detecting means for sampling said tag signal a plurality of times during each sweep and in synchronism with the sweep rate, and integrating each sample over a plurality of sweeps; and means coupled to said integrating means for monitoring the value of the integrated samples and providing a detect signal in response thereto upon the detection of a predetermined number of integrated samples whose value exceeds a predetermined value.

12. A detector as recited in claim 11 wherein said detect signal providing means is responsive to pulses received from said integrating means and includes means for determining the widths of the pulses received from said integrating means, said detect signal providing means being responsive to the widths of said received pulses for providing a detect signal only if the widths of said pulses exceed a predetermined width.

13. A detector as recited in claim 11 wherein said detect signal providing means is responsive to pulses received from said integrating means, and includes means for counting the pulses received from the integrating means and for providing said detect signal only if a predetermined number of pulses are received within a predetermined time interval.

14. A detector as recited in claim 11 wherein said tag produced signal detecting means includes threshold means for passing signals detected by said tag produced signal detecting means only if the amplitude of the detected signals exceed a predetermined amplitude.

15. A system as recited in claim 11 wherein said synchronous integrator includes means responsive to the polarity of the detected signal.

16. A system as recited in claim 11 wherein said synchronous integrator is responsive to the amplitude of the detected signal.

17. A detector for detecting the presence of a resonant tag in a swept frequency field, comprising:

means for detecting the signal produced by a tag present in the swept frequency field;

means including a synchronous integrator coupled to said detecting means for integrating the detected signals; and means coupled to said integrating means for providing a detect signal in response thereto upon the detection of a tag produced signal, wherein said detect signal providing means is responsive to pulses received from said integrating means, and includes means for counting the pulses received from the integrating means and for providing said detect signal only if a predetermined number of pulses are received within a predetermined time interval, and wherein said counting means includes means for providing said detect signal only if at least a first predetermined number of pulses are received within a first predetermined time interval and no more than a second predetermined number of pulses are received in a second predetermined time interval.

18. A detector as recited in claim 17 wherein in said counting means further includes means for providing said detect signal only if at least a third predetermined number of pulses are received within a third predetermined time interval, said third predetermined time interval being longer than said first and second predetermined time intervals.

19. A detector as recited in claim 18 wherein the length of said third predetermined time interval is greater than twice the length of said second predetermined time interval.

20. A detector as recited in claim 18 wherein the length of said third predetermined time interval is on the order of approximately twice the length of said second predetermined time interval.

* * * * *

UNITED STATES PATENT AND TRADEMARK OFFICE

CERTIFICATE OF CORRECTION

PATENT NO. : 4,812,822

DATED : March 14, 1989

INVENTOR(S) : FELTZ et al

It is certified that error appears in the above-identified patent and that said Letters Patent is hereby corrected as shown below:

Column 1, Line 17, "big" should be --tag--;
Column 14, Line 8, after "wherein", delete --in--.

Signed and Sealed this

Sixth Day of February, 1990

*Attest:*

JEFFREY M. SAMUELS

*Attesting Officer*

*Acting Commissioner of Patents and Trademarks*